US009940913B1

(12) United States Patent
Harrison

(10) Patent No.: US 9,940,913 B1
(45) Date of Patent: Apr. 10, 2018

(54) ROTATIONAL PIVOT STRUCTURE WITHIN SINGLE REED WOODWIND LIGATURE SYSTEM

(71) Applicant: Joel Norval Harrison, Campbell, CA (US)

(72) Inventor: Joel Norval Harrison, Campbell, CA (US)

( * ) Notice: Subject to any disclaimer, the term of this patent is extended or adjusted under 35 U.S.C. 154(b) by 0 days.

(21) Appl. No.: 15/732,133

(22) Filed: Sep. 20, 2017

Related U.S. Application Data

(60) Provisional application No. 62/495,619, filed on Sep. 20, 2016.

(51) Int. Cl.
*G10D 9/02* (2006.01)

(52) U.S. Cl.
CPC ..... *G10D 9/02* (2013.01)

(58) Field of Classification Search
CPC ..... G10D 9/02; G10D 9/023
See application file for complete search history.

(56) References Cited

U.S. PATENT DOCUMENTS

2011/0162508 A1* 7/2011 Rovner ..... G10D 9/02 84/383 R

* cited by examiner

*Primary Examiner* — Kimberly Lockett

(57) ABSTRACT

A single reed woodwind ligature system has an upper U-shaped structure for contacting the upper portion of a mouthpiece at one or more small areas of contact and for engaging a lower structure, preferably by threaded ends and nuts. A reed contactor plate contacts a reed at a portion of its bottom curved surface. At least one ball bearing sphere is located in aligned cavities of the lower structure and the reed contactor in a spaced-apart configuration and forms a pivot mechanism capable of roll, pitch and yaw rotations in three dimensions around the approximate center of the at least one sphere. Embodiments include multiple spheres and sphere-bearing pin contact combinations forming the three-dimensional adjustable pivot. A retainer holds the spherical pivot components together when the ligature system is not clamping the reed to the mouthpiece without hampering user adjustments in the three normal (roll, pitch and yaw) dimensional ranges.

20 Claims, 10 Drawing Sheets

Section B-B

Section A-A

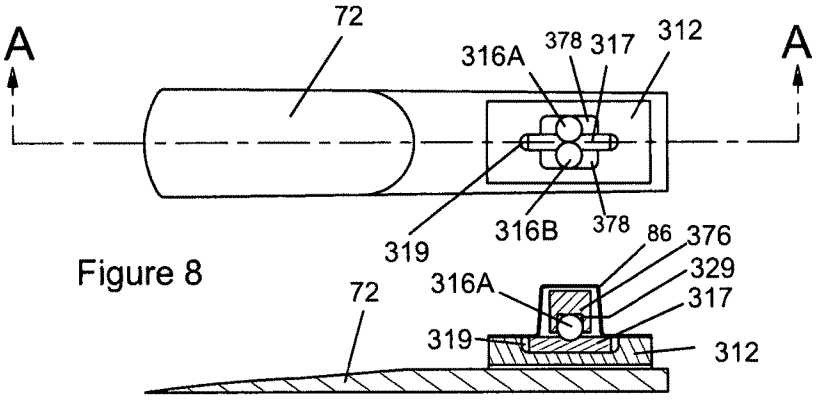
Figure 8
Figure 8A
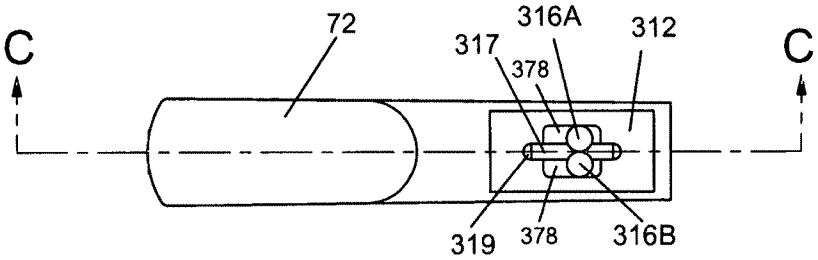
Figure 10
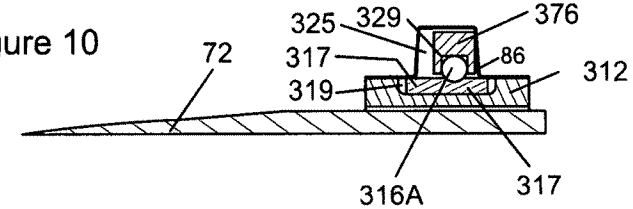
Figure 10A
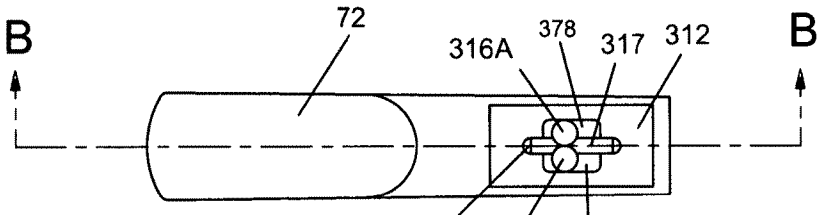
Figure 9
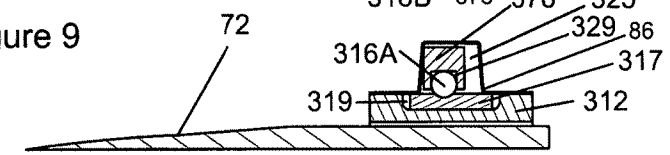
Figure 9A

ROTATIONAL PIVOT STRUCTURE WITHIN SINGLE REED WOODWIND LIGATURE SYSTEM

REFERENCE TO RELATED PROVISIONAL PATENT APPLICATION

Priority is claimed based upon my prior U.S. Provisional Patent Application Ser. No. 62/495,619 filed Sep. 20, 2016, the disclosure thereof being incorporated herein in its entirety.

BACKGROUND OF THE INVENTION

A. Field of the Invention

This invention pertains to an improved ligature for single reed musical instruments having unique rotational pivot structure mechanisms.

B. Description of the Prior Art

I hereby incorporate by reference the entirety of the disclosure of my prior U.S. Pat. No. 8,940,988, issued on Jan. 20, 2015 for Single Reed Woodwind Ligature System Adjusts to Fit Most Mouthpiece Sizes with Excellent Responsiveness through Isolation of Ligature from Reed and Mouthpiece Vibrations. My prior patent points out the importance of minimizing vibrational coupling between reed and mouthpiece via the ligature structure while it effectively positions and holds the reed securely in place.

As disclosed in my referenced patent some popular ligature designs have a rotatable reed contactor that touches the reed during use and is attached to the ligature by a rotational pivot mechanism. The mechanical vibrational energy transmitted and absorbed by the rotational pivot mechanism to the ligature has a significant effect upon the sound produced, the responsiveness felt by the musician, and the possible dynamic range of sound produced by the woodwind instrument.

Conventional reed contactor pivoting ligatures have a performance consistency problem. An anecdotal example of this occurred several years ago when the present inventor discussed ligatures with a world famous tenor sax player who was playing a conventional Otto Link style ligature on his metal mouthpiece. He mentioned that his search for a great ligature took him more than a decade and about 150 units to find his present very high performance ligature. This story demonstrates that ligatures of the same nominal design can have a wide variation of actual performance.

An important motivation for this invention was the inventor's experience with customer feedback about ligatures produced from his cited patent. While the performance of the ligature in most cases was excellent the performance variation was wider than expected. The cause of much of the variation was attributed to the pivot mechanism which used a precision pin that provided a pivot which provided approximate line contact with a concave surface of a machined hole. The machined hole had too much variation between manufactured units.

One example of a prior art ligature is found in a published U.S. Patent application, publication number US2014/0305279A1, published on Oct. 16, 2014. Its disclosure is hereby incorporated in its entirety herein. While this disclosure describes a ball and socket pivoting mechanism, it continues to repeat some of the drawbacks of prior approaches. First, its flexible ligature band remains in substantial contact with the mouthpiece for substantially the entire circumference thereof, thereby transferring whatever vibrational energy from the reed is carried by the ligature mechanism. Also, the ball segment and socket pivot mechanism described is complicated and expensive to manufacture in quantity. A custom threaded screw has the ball segment formed apparently by machining one end of a first user-adjustable tightening screw in a manner maintaining a small cylindrical and integral stem between the ball segment and the screw. Based on the present inventor's experience, it would be very difficult to manufacture the tightening screw with the stem and ball segment with a consistency of structure and performance realized with the spherical pivot structures disclosed herein at a competitive cost per unit. Of greater difference from the present invention, the ball segment engages a thin washer held in place by a second set screw in a body formed as part of a reed contactor plate. The spherical surface thus contacts an annulus defined by the washer. This annular area of contact necessarily transfers vibrational energy from the reed and contactor plate into the ligature mechanism. As noted, since the disclosed ligature band remains in substantial widespread contact with the mouthpiece, whatever vibrational energy is transferred by the annular contact between the sphere segment and the washer is thereby transferred to the mouthpiece. This condition is significantly minimized in the present invention.

The present inventor's experience has shown that great ligatures absorb less vibrational energy from the vibrating reed-mouthpiece-ligature system than ordinary ones of the same design.

SUMMARY OF THE INVENTION

This patent discloses improvements to the category of ligatures that has a reed contacting plate that touches the reed during use which is attached to the ligature body structure by a an improved pivot mechanism.

One objective of this invention is to greatly reduce the contact areas between a reed contacting plate and a ligature body structure to dramatically reduce the amplitude of vibrations that are transmitted to and absorbed by the ligature body structure to improve the responsiveness of the musical instrument.

Another objective of this invention is to enable consistent high performance between individual ligature instances of the same nominal design.

Yet another objective of this invention is to create minimal contact area ligature pivots from the combinational use of abundant low cost smooth and hard precision elements such as readily available commodity ball bearing spheres in combination or in cooperation with one or more cylindrical bearing pins to create a high performance ligature pivot.

One more object of this invention is to disclose multiple design embodiments that are implemented by various combinations of the above mentioned low cost precision contacting elements.

In accordance with the teachings of the present invention, there is disclosed a ligature system and ligature components for use on a mouthpiece of a woodwind type single reed musical instrument. The ligature system includes at least one bearing ball sphere maintained in precise position by cavity features formed in alignment in the reed contacting plate and a lower beam structure of the ligature mechanism in an arrangement that provides at least two rotational degrees of freedom to allow the reed contacting plate to align with both the reed and the tapered angle of a mouthpiece. A retainer member between the reed contacting plate and the lower beam structure retains the at least one sphere in position when the ligature mechanism is loosened or removed from the mouthpiece of a single reed instrument.

BRIEF DESCRIPTION OF THE DRAWINGS

In the drawings:

FIG. 8 is a diagrammatic plan view of a reed and reed contactor plate forming a pivot having a single bearing pin and two bearing ball sphere in contact with the pin and showing a central longitudinal position of bearing ball spheres within a user-adjustable range.

FIG. 8A is a sectional view of the FIG. 8 structure adding the retainer and beam structure as taken along section line A-A in FIG. 8.

FIG. 9 is a diagrammatic plan view of the reed and reed contactor plate shown in FIG. 8 wherein the pair of bearing ball spheres is displaced longitudinally toward a longitudinal center of the reed within the reed contactor plate.

FIG. 9A is a sectional view of the FIG. 5 structure adding the retainer and beam structure as taken along section line B-B in FIG. 9.

FIG. 10 is a diagrammatic plan view of the reed and reed contactor plate assembly shown in FIG. 8 wherein the pair of bearing ball spheres is displaced longitudinally away from the longitudinal center of the reed within the reed contactor plate.

FIG. 10A is a sectional view of the FIG. 10 structure adding the retainer and beam structure as taken along section line C-C in FIG. 10.

DETAILED DESCRIPTION OF PREFERRED EMBODIMENTS

The frame of reference for this disclosure is that of a musician producing a musical note on a woodwind instrument with a mouthpiece, reed and ligature installed. The terms 'top', 'bottom', 'left', 'right', 'upper' and 'lower', 'vertical' and 'horizontal' also refer to this same point of view. A coordinate system using this same frame of reference has a horizontal 'X' axis, and a vertical 'Y' axis, with a 'Z' axis toward and away from the musician. Pitch rotations rotate around an axis parallel with the 'X' axis. Roll rotations rotate around an axis parallel with the 'Z' axes and 'yaw' rotations revolve around an axis parallel with the 'Y' axes.

Figure 1B:
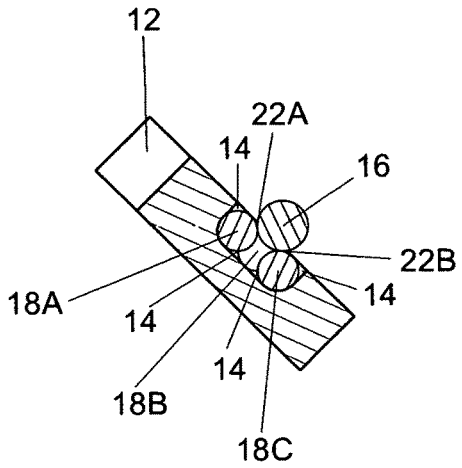
FIG. 1B is a rotated central cross-section along line B-B of FIG. 1A with a 45 degree rotation about the y axis to show two of the four contact points between the large sphere and smaller spheres.
Figure 1:
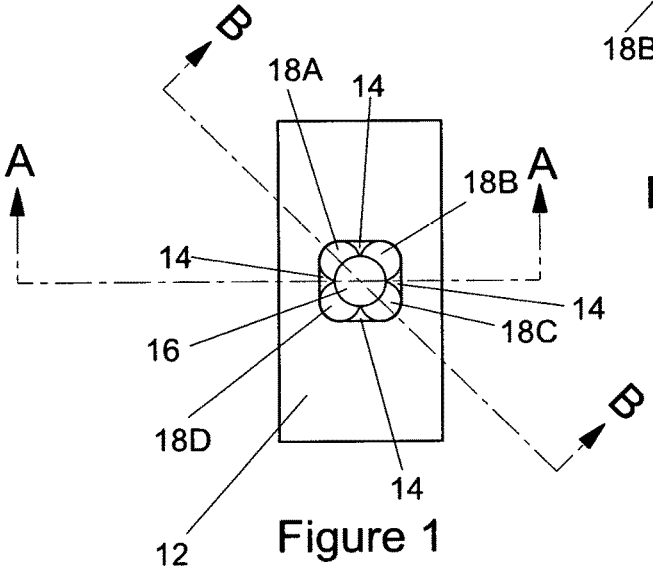
FIG. 1 is a bottom plan view of a reed contactor which contains four precision small spheres that are shown touching one larger sphere at tour contact points.
Figure 1A:
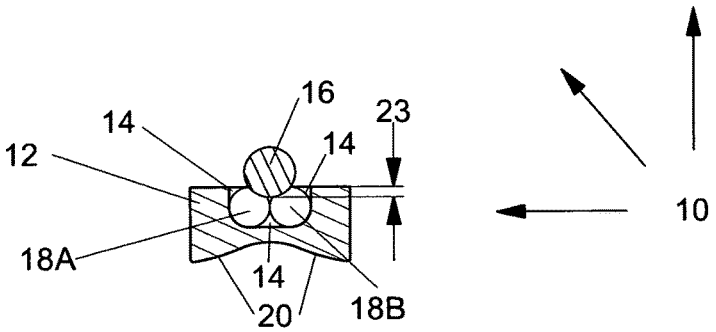
FIG. 1A is a central X-Y cross-section taken along line A-A of the reed contacting plate and large sphere that is shown in FIG. 1A. Also shown in FIG. 1B are two of the four precision small spheres. The curved reed contacting surface cross-section is also shown.

FIGS. 1, 1A, and 1B disclose a ligature reed contactor pivot subassembly 10 in accordance with principles of the present invention. FIG. 1 shows an enlarged diagrammatic bottom planar view in the X-Z plane of a reed contactor 12 which defines a radiused generally rectangular cavity 14 that has essentially curved and straight surfaces sized and arranged to receive and contain four hard, smooth and precision small spheres 18A, 18Bb, 18C and 18D with sufficient clearance, precision and rigidity to constrain reed clamping forces without large deflections within the cavity 14. A larger size round, smooth and hard sphere 16 is shown resting on the four spheres 18 (sometimes collectively referred to herein by the single reference numeral 18) with four contact points in FIGS. 1, 1A and 1B.

FIG. 1A presents a central cross-section end view along line A-A of FIG. 1 in the x-y plane of the subassembly 10. FIG. 1A shows reed contactor 12, cavity 14, a full cross-section of large sphere 16, and two spheres 18A and 18B that extend beyond the cross-sectional cutting plane along line A-A of FIG. 1. Also shown is the cross-sectional curve of a symmetrical curved prismatic surface 20 which contacts the back curved side of a reed along two outer longitudinal narrow surfaces during use for clamping a reed to a mouthpiece. Because of the depth of the cavity 14 the bottom point of the large sphere 16 is lower than the approximate plane created by the top points of the four small spheres 18. This creates an intrusion gap denoted by reference numeral 23 in FIG. 1A which prevents unwanted disassembly of the ligature reed contactor pivot sub-assembly (in combination with a retainer) when the ligature mechanism is released from the mouthpiece and reed by the user. The intrusion gap 23 also enables forces in the Y-Z plane to be resisted by the ligature mechanism. Inter-sphere contact points 22A and 22B as shown in FIG. 1B can be described as convex areal contact points where the contact looks like point contact to the naked eye but in reality is a very small approximately circular area of contact that varies elastically with the reed clamping force that is applied through the rotatory pivot to clamp a reed to a mouthpiece. The four contact points between small spheres 18A, 18B, 18C, 18D and large sphere 16 help minimize transfer of vibrational energy from the reed contactor, the ligature structure and mouthpiece.

FIG. 1B presents a 45 degree rotated central cross-section along line B-B of FIG. 1 through reed contactor 12, the large sphere 16, and two of the small spheres 18A and 18C. The large sphere 16 is shown to be in contact with the two small spheres 18A and 18C in this view, with the small sphere 18B shown behind small spheres 18A and 18C. The large sphere 16 is also in contact with spheres 18B and 18D, although not shown as such in the FIG. 1B sectional view. Shown also in FIG. 1B are two of the four sphere-to-sphere contact regions 22A and 22B with large sphere 16. (Note that the four sphere-to-sphere contact regions 22A and 22B with large sphere 16. (Note that the three dimensional reed contacting surface 20 that is shown correctly in FIG. 1A is shown incorrectly in FIG. 1B as a plane rather than a curve). The points of contact between large sphere 16 and spheres 18A, 18B, 18C and 18D create four convex contact points 22 (contact points 22A and 22B being illustrated in FIG. 1B). These plural contact points describe the characteristics of forced contact between precise, smooth and hard round elements that appear to be points of contact to the naked eye but are very small areas of contact when viewed under a microscope.

The arrangement of the FIG. 1 contactor plate subassembly aids creation of a three dimensional rotational pivot mechanism 70 (shown in assembly in FIGS. 2 and 2A) with a center of rotation near the center of large sphere 16. For a special case example a pure pitch rotation about a vertical axis through the center of sphere 16 would cause the contact points between large sphere 16 and small spheres 18A, 18B, 18C and 18D to move along an approximately planar circular path. This logical and physical concept extends to general three dimensional approximately spherical rotations of the large sphere 16 with respect to the small spheres 18A, 18B, 18C, 18D, thus creating a pivot mechanism capable of roll, pitch and yaw rotations around the approximate center of the large sphere 16.

The contactor plate subassembly shown as 10 in FIGS. 1, 1A and 1B is not a complete ligature as nothing yet expressly disclosed herein so far is attached to, or in contact with, the large sphere 16. We can mentally visualize the reed clamping force capability of this subassembly by resting a standard reed on a horizontal flat surface and also placing the reed contact surface 20 of reed contactor 12 on the reed. Applying an approximately vertically downward force to the top of sphere 16 would provide a force that would clamp the reed to the horizontal flat surface of the mouthpiece.

Because there are four small spheres 18 making contact with the single large sphere 16 the pivot system is statically redundant as there is the possibility that small dimensional imperfections in the manufacturing of the components could cause only three points of contact between the spheres. Experience has shown that small dimensional imperfections of the cavity 14 in the range of about 0.002 inch using high precision bearing spheres 16 and 18 are overcome by the usual reed clamping forces applied during use to sphere 16 because of elastic deformations of the contacting elements that result in four contact points between large sphere 16 and the four small spheres 18. Spheres 18 were chosen as the same size to simplify the shape of the cavity 14. The central sphere 16 could be the same, larger or smaller than the spheres 18. For the exemplary embodiment the four small spheres 18 are ⅛ inch diameter and the larger sphere 16 has a diameter of 5⁄32 inch. The term "sphere" as used herein defines and includes highly polished small round hardened steel balls of the type commonly found in ball bearing assemblies, and thus the term sphere is not restricted or limited to its pure mathematical definition, taking into consideration manufacturing tolerances present in mass produced small spherical balls of the type commonly used in ball bearing assemblies.

The cavity 14 in the reed contactor 12 is shown as a cavity machined or precision molded in solid material. The exemplary embodiment has the reed contactor 12 made of machined brass bar or machined or molded from fiber reinforced plastic. And cavity 14 is machined by a spherically shaped tip of an end mill cutting tool. The requirements of the cavity are such that the four spheres fit at near the same plane with the depth of the cavity more than half the diameter of the small spheres 18 for stability. A nearly sharp-cornered cavity would provide three points of contact for each of the four small spheres 18. The use of radiused corners establishes smoother contact between the spheres and the cavity. A first advantage of this four sphere cavity is the ease of parallel wall linear measurement with standard measuring tools. The largest actual pivot angle used with a front-to-back symmetrical ligature is a roll angle about an axis normal to the y-z plane. The reed contactor cavity 14 creates a front-to-back symmetrical pivot which is the second advantage of using a four-sphere cavity, such as cavity 14. An intrusion gap 23 is shown in FIG. 1A which enables a portion of the large sphere 16 to be recessed within the cavity 14 at contact points 22A and 22B (FIG. 1B) when in contact with the small spheres 18. The intrusion gap 23 has a nominal 0.031 inch width in this exemplary embodiment.

One design choice is whether the four spheres 18 should be pressed into cavity 14 or be installed with a slight clearance. The exemplary embodiment uses a 0.002 inch to 0.004 inch clearance in both directions to enable the spheres to be installed without being pressed or glued into place. A disadvantage of a non-fixed fit is that one or more of the spheres 18 can easily be lost during the assembly operations.

There are two important reasons for using precision hard round and very smooth spheres to create the disclosed pivot. The first is consistent performance. The mechanical vibrational energy transmitted between the reed contactor through the pivot depends on very small contact areas which is achieved using the precision spheres. The second advantage is the low cost commodity status of hard steel ball bearing balls as the spheres. In 2016 in California the cost for 5000 very precise and smooth ball bearing spherical balls for 1000 units cost only about $0.04 for the five balls for one ligature pivot of the type herein described.

Figure 2A:
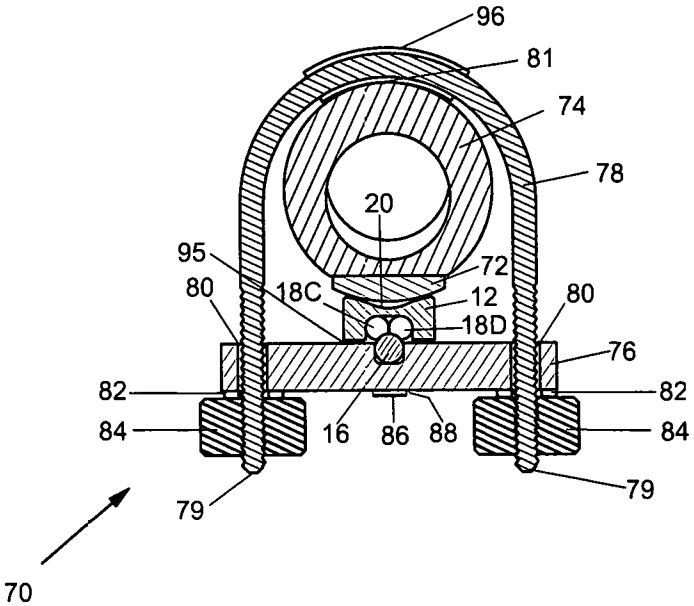
FIG. 2A is a sectional view of the FIG. 2 ligature mechanism taken along line A-A in FIG. 2.
Figure 2:
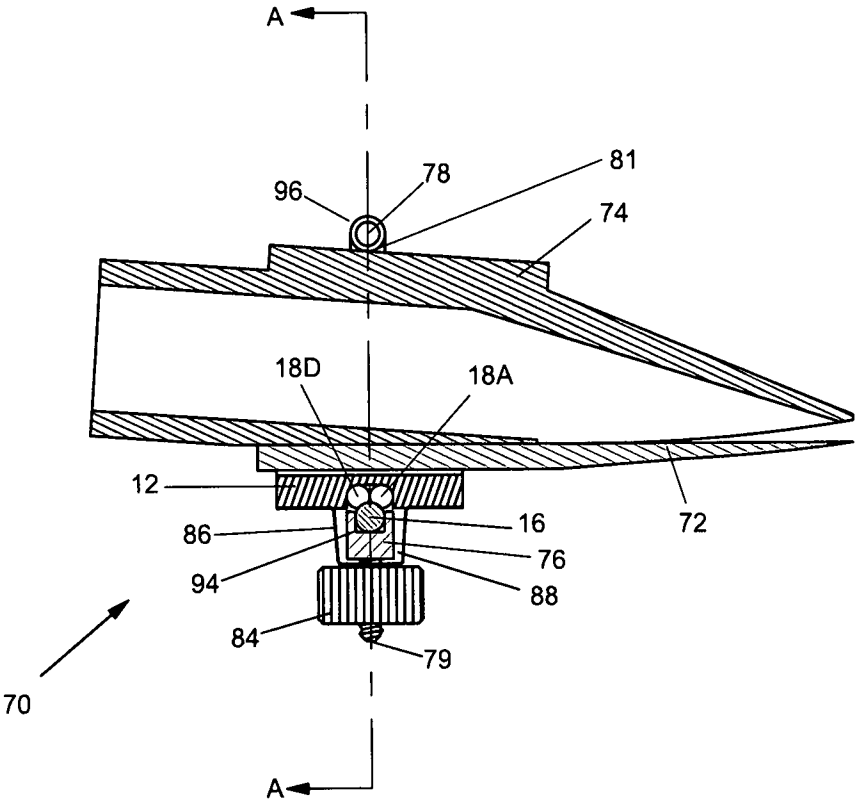
FIG. 2 shows a longitudinal cross-section of a ligature, reed and mouthpiece with an improved rotational pivot embodiment shown in FIGS. 1A, 1B and 1C.

FIG. 2 shows a diagrammatic longitudinal cross-sectional view of a ligature assembly 70 and FIG. 2A shows the assembly 70 in cross-section along section line A-A in FIG. 2. As shown therein, the ligature assembly 70 cooperates to clamp a reed 72, to a mouthpiece 74 along curved contact points through the improved rotational pivot mechanism 10 (not indicated in this view) comprising reed contactor 12, the plurality of small spheres 18, a retainer 86, and a large sphere 16 held in place by a precisely formed and aligned cavity 94 in a lower beam structure 76. Threaded ends 79 of a generally U-shaped upper beam structure 78 pass through slightly oversized clearance holes 80 of the lower structure 76 at both the left and right sides. Left and right side washers 82 and threaded finger nuts 84 enable a user to clamp the reed 72 between reed contactor 12 and mouthpiece 74 by applying pressure on the lower structure 76. The generally U-shaped retainer 86 is shown as defining a gap 88 around the lower beam structure 76. The gap between the lower beam structure 76 and the retainer must be sufficiently large to tolerate a range of misadjustment, yet be sufficiently narrow to keep the large sphere 16 engaged within the cavity 94 when the ligature structure 70 is not clamping the reed 72 to the mouthpiece. The retainer 86 may be attached to the reed contactor 12 in conventional fashion via screws, rivets or adhesive or thermal bonding for the exemplary embodiment. Also shown in FIG. 2A is the small surface contact area 81 between the top of mouthpiece 74 and upper U-shaped structure 78. A plastic sleeve 96 is preferably slipped over the generally U-shaped structure 78 to promote frictional engagement with the mouthpiece at the contact area 81 and also to reduce possible marring of a mouthpiece made of relatively soft material.

Figure 2C:
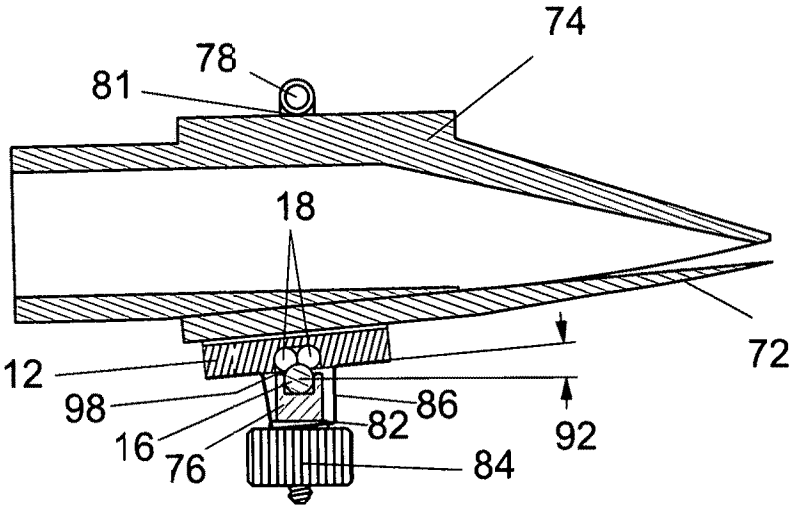
FIG. 2C is a side cross section of the mouthpiece, reed and ligature assembly shown in FIGS. 2 and 2A, demonstrating the pitch rotational capability of the new pivot mechanism.
Figure 2B:
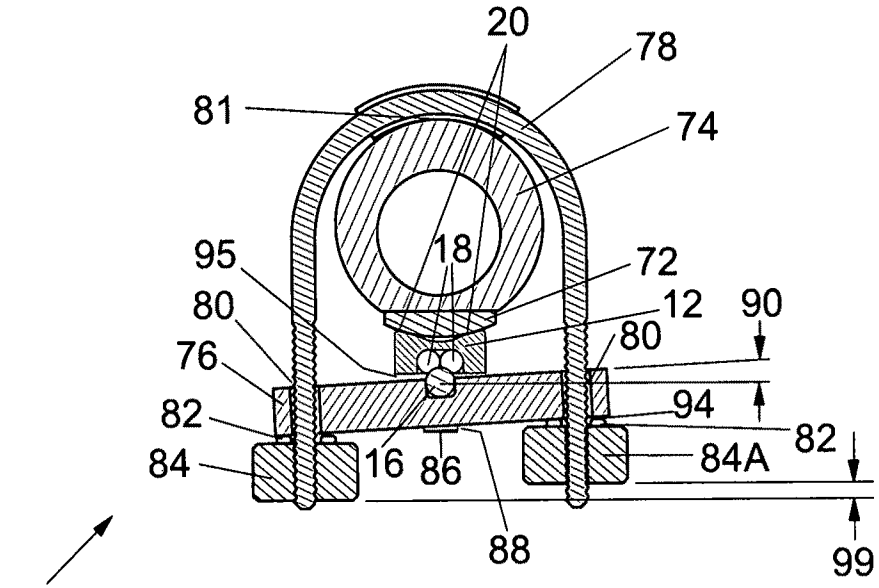
FIG. 2B is a central cross-section of the mouthpiece, reed and ligature assembly shown in FIGS. 2 and 2A, demonstrating the roll rotational capability of the new pivot mechanism.

FIG. 2B illustrates a Z axis roll angular misalignment of the ligature body 76 with respect to the mouthpiece 74, reed 72 and reed plate 12 and upper structure 78 which is caused by a roll rotation about the Z axis of the ligature body at approximately the center of the large sphere 16. The ligature body is rotated, along a rotation angle 90 as shown in the figure. Notice also the right finger nut 84A was rotated to new position 99 to cause the misalignment angle 90. This view shows that the present ligature system has an alignment tolerance range for the user without losing its vibrational isolation effectiveness for misadjustments within the range. Retainer gap 88 is shown in FIG. 2B as limiting the roll angle 90 to a maximum of approximately five (5) degrees in this embodiment of the invention. The retainer 86 is preferably made of sheet metal or plastic with a nominal gap of 0.020 inches. The washers 82 provide a clearance step to reduce the diameter of contact of finger nuts 84 to the bottom of beam 76 which simplify finger nuts 84 to be approximately symmetrical.

The FIG. 2C side cross-sectional section of the mouthpiece 74, reed, 72 and ligature assembly 70 demonstrates the pitch rotational capability of the new pivot mechanism. The mouthpiece 74 is shown touching the top of the upper structure 78 at contact location 81. Reed 72 is shown clamped between the mouthpiece 74 and the reed contactor 12. Rotation angle 92 shows the range of rotational capability of the reed plate 12 around the approximate center of the large sphere 16 (being touched by contact areas of the four small spheres 18, two of which are shown in this figure). Also shown in FIG. 2C are beam 76, threaded nut 84, washer 82 and retainer 86.

The range of a roll rotation has two components. First, during use while clamping a reed, a gap 95 separating the contactor 12 limits directly the range of motion as contact is made between the reed contactor structure 12 and a top wall of the lower structural beam 76. The nominal rotational range for a clamped reed enabled by this embodiment is plus or minus approximately five (5) degrees which is governed by gap 95 between the contactor 12, the transverse dimension of the lower edges of the contactor 12, and the top wall of the lower beam structure 76. The angular range limit when the ligature system is not clamping the reed 72 to the mouthpiece 74 is slightly larger as constrained by the retainer 86. The FIG. 2B sectional view shows a thin line of contact between a flat bottom surface of the lower beam structure 76 and the left edge of the retainer 86 in this view. The resultant thin line contact in the roll rotation limit minimizes vibrational coupling between the ligature structure 70 and the mouthpiece 74. The FIG. 2C sectional view shows a thin line of contact between a longitudinal edge of the beam structure 76 and the bottom wall of the retainer 86. The resultant thin line contact in the pitch rotation limit again minimizes vibrational coupling between the ligature structure 70 and the mouthpiece 74.

As shown in FIG. 2, the U-shaped upper clamping member 78 preferably has a circular cross section along a line of contact 81 to the mouthpiece 74 as shown in FIG. 2A. The line of contact arrangement has adequate friction area between the two components 78 and 74 but may mar the top of soft mouthpieces. To further improve the friction between the line of contact between the U-shaped clamping member 78 and the mouthpiece 74, the clear plastic tube segment 96 can be inserted onto the clamp 78 and positioned at the contact line 81 prior to assembly and clamping of the completed ligature structure and reed to the mouthpiece preparatory to usage in the intended fashion. Clear plastic tube 96 greatly increases the friction between clamping member 78 and mouthpiece 74 while reducing or eliminating mouthpiece marring. Alternatively, the U-shaped clamping member 78 may have an approximately square or rectangular cross section to promote frictional retention of the mouthpiece, with or without the plastic tube segment 96. The clamping member 78 having a circular cross-section is presently preferred.

Figure 3:
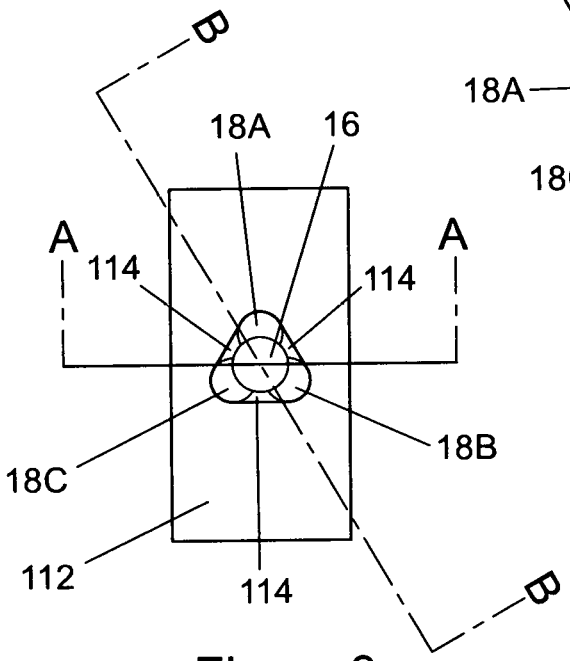
FIG. 3 is an enlarged, diagrammatic bottom plan view of a reed contactor structure which contains three precision small spheres that are shown touching one larger sphere at three contact points.
Figure 3B:
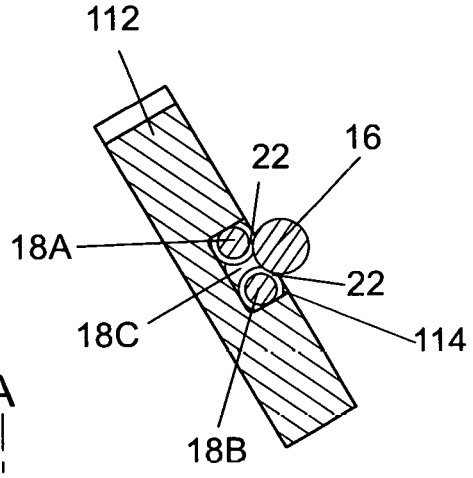
FIG. 3B is a sectional view of the FIG. 3 structure taken along section line B-B in FIG. 3.
Figure 3A:
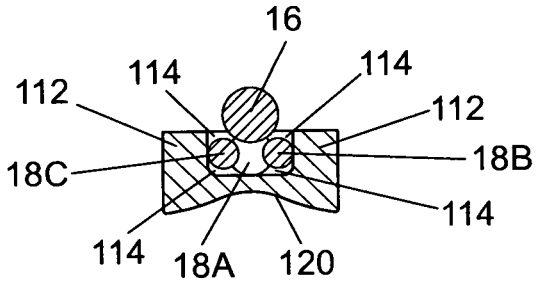
FIG. 3A is a sectional view of the FIG. 3 structure taken along section line A-A in FIG. 3.

A second presently preferred embodiment is illustrated in FIGS. 3, 3A and 3B, wherein structural and functional elements unchanged from the first preferred embodiment bear the same reference numerals. In this second preferred embodiment a reed contactor plate 112 defines a central recess region 114 having a generally triangular plan shape. In this embodiment, the recess 114 is sized and shaped to receive, contain and constrain three small ball bearing spheres 18A, 18B and 18C in an arrangement such that when the large ball bearing sphere 16 is in place as shown in FIGS. 3, 3A and 3B, three contact points 22 are formed between the large sphere 16 and the three smaller spheres 18A, 18B and 18C. Other than the substitution of the three-sphere-containing contactor plate 112 for the four-sphere-plate 12, the ligature structural elements remain the same as shown in FIGS. 1, 1A, 1B. 1C, 2, 2A, 2B and 2C as described above.

It will be readily apparent to those skilled in the art that the principles of this system extend to a ligature assembly in which a single sphere, such as sphere 16, is constrained between the contactor structure 12 and the lower beam structural member 76 by aligned, single ball cavities defined in the contactor 12 and the beam 76.

Figure 4:
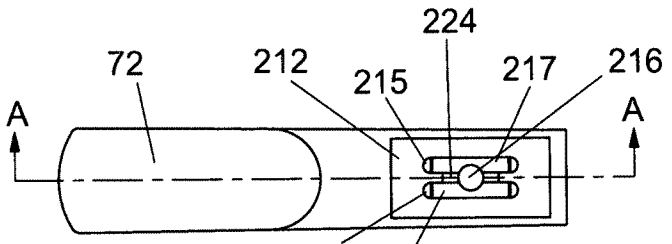
FIG. 4 is a diagrammatic plan view of a reed and reed contactor plate comprising two bearing pins and a single bearing ball sphere in contact with the pins, and showing a central longitudinal position within a user-adjustable range.
Figure 4A:
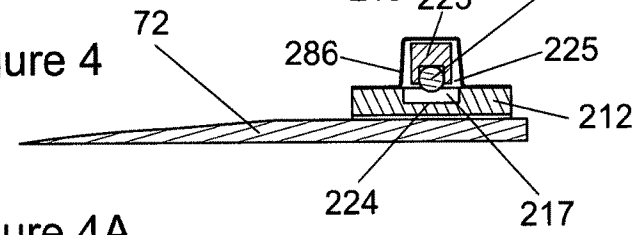
FIG. 4A is a sectional view of the FIG. 4 structure and adding the retainer and beam structure as taken along section line A-A in FIG. 4.
Figure 5:
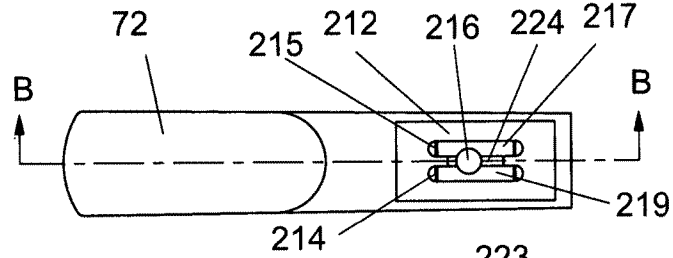
FIG. 5 is a diagrammatic plan view of the reed and reed contactor plate shown in FIG. 4 wherein the single bearing ball is displaced longitudinally toward a longitudinal center of the reed within the reed contactor plate.
Figure 5A:
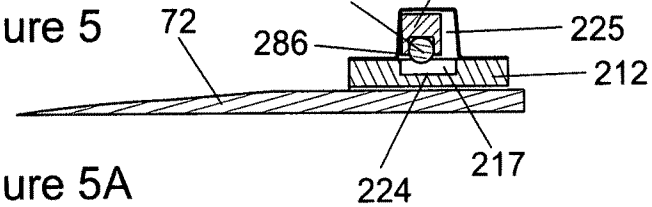
FIG. 5A is a sectional view of the FIG. 5 structure and adding the retainer and beam structure as taken along section line B-B in FIG. 5.
Figure 6:
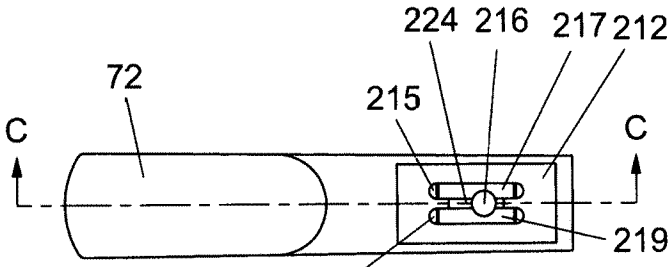
FIG. 6 is a diagrammatic plan view of the reed and reed contactor plate assembly shown in FIG. 4 wherein the single bearing ball is displaced longitudinally away from the longitudinal center of the reed within the reed contactor plate.
Figure 6A:
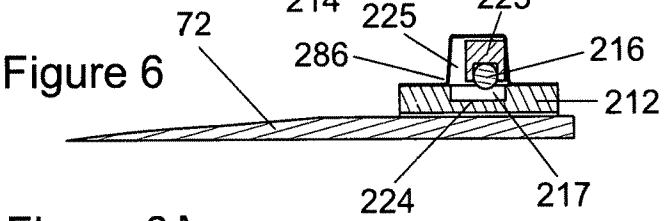
FIG. 6A is a sectional view of the FIG. 6 structure and adding the retainer and beam structure as taken along section line C-C in FIG. 6.

A third presently preferred embodiment is illustrated in FIGS. 4, 4A, 5, 5A, 6, 6A, 7 and 7A. In this embodiment, a reed contactor plate 212 contacts a reed 72 in the manner previously described along two parallel contact lines. The contactor plate 212 defines two longitudinal slots 214 and 215. The slots preferably have a generally cylindrical contour along each longitudinal axis thereof. The slots 214 and 215 are sized to receive closely there within cylindrical bearing pins 217 and 219. A single, appropriately dimensioned ball bearing sphere 216 is held in contact with lineal surface contact lines of the pins 217 and 219 by a beam structure 223 defining a recess 227 sized to receive and retain a major portion of the single ball sphere 216. A retainer 286 rigidly connected at each end to the reed contactor plate 212 by conventional means retains the beam structure 223 in place against the pins 217 and 219. Gap or open space 224 provides clearance such that ball 216 always touches pins 217 and 219 and not contactor plate 212. FIGS. 5 and 5A illustrate a clamping position applying a force at a position on the left side of the plate 212 as viewed in these two figures, such that the reed clamping force is asserted closer to a central longitudinal point of the reed 72. By way of contrast, FIGS. 6 and 6A illustrate a clamping position applying a force at a position on the right side of the plate 212 as viewed in these two figures, such that the reed clamping force is asserted farther away from the central longitudinal point of the reed 72 than shown in FIGS. 4, 4A or 5 and 5A. The open space 224 enables the resultant ligature structure 270 to tolerate misadjustment by the user over a clamping range along the Z axis without significantly degrading the desired vibrational isolation of the ligature structure from the mouthpiece.

In the embodiment illustrated in FIGS. 4, 4A, 5, 5A, 6, 6A, 7 and 7A, the bearing ball sphere 216 is shown to have a diameter somewhat greater than the cross sectional diameters of pins 217 and 219. Those skilled in the art will appreciate that the relative sizing of elements 216, 217 and 219 is up to the designer, and should not be construed as limiting the arrangement to the relative sizes illustrated in these figures.

Figure 7A:
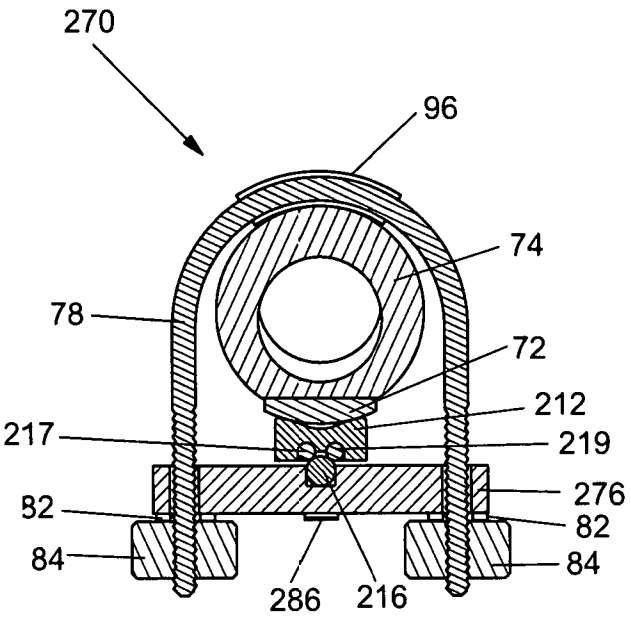
FIG. 7A is a sectional view of the FIG. 7 elements taken along section line A-A in FIG. 7.
Figure 7:
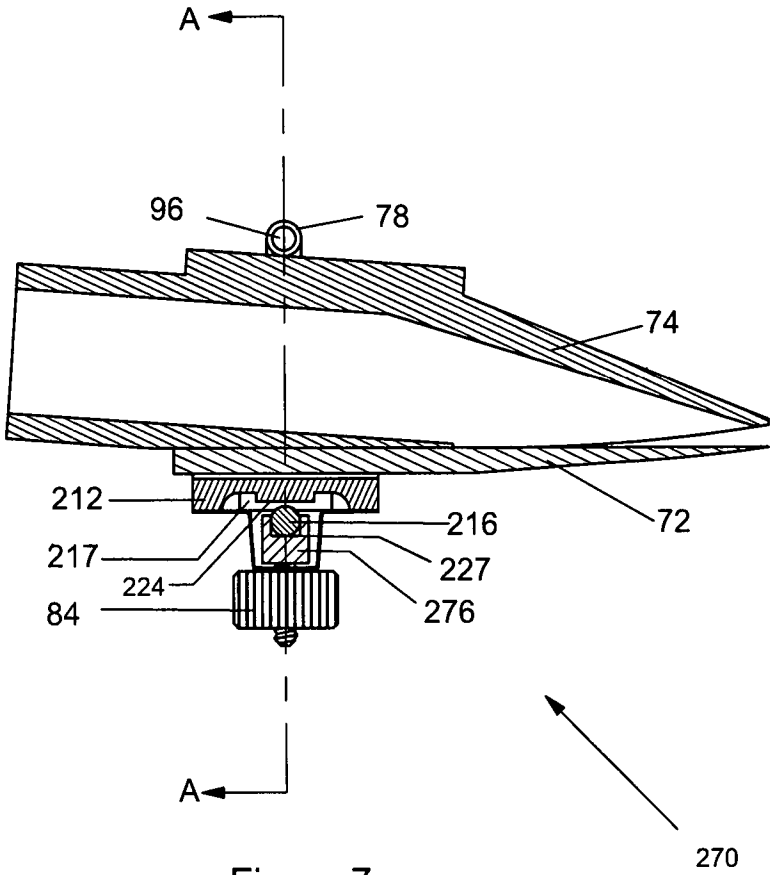
FIG. 7 is a sectional view of the FIG. 4 reed and reed contactor plate within a ligature structure, reed and mouthpiece.
Figure 11A:
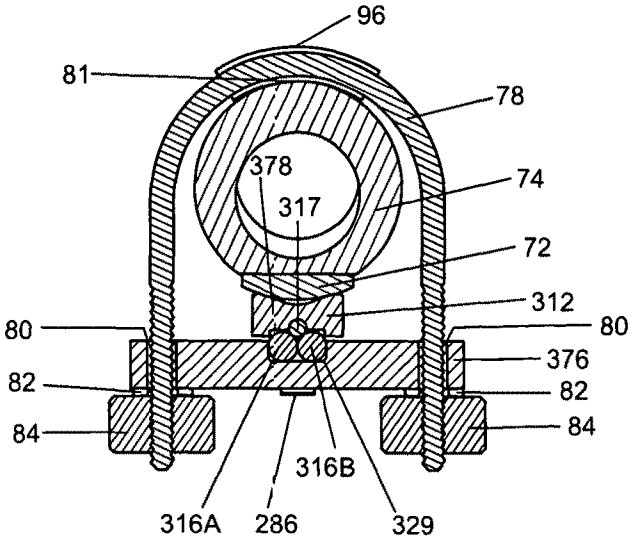
FIG. 11A is a sectional view of the FIG. 11 elements taken along section line A-A in FIG. 11.
Figure 11:
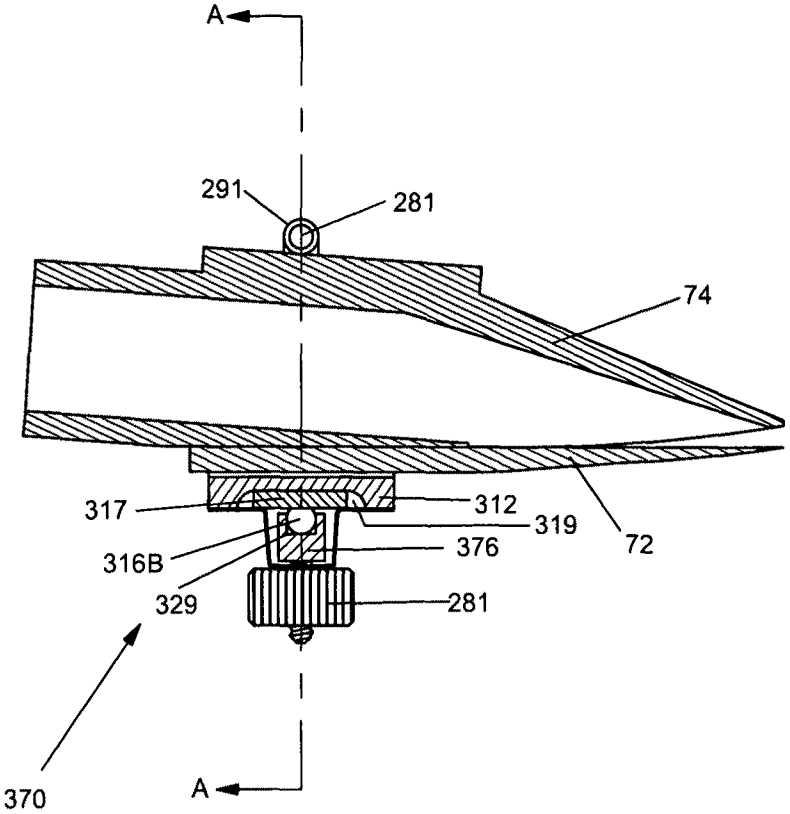
FIG. 11 is a sectional view of the FIG. 8 reed and reed contactor plate within a ligature structure, reed and mouthpiece.

The FIGS. 7 and 7A views show the ligature assembly 270 attached to a reed 72 and mouthpiece 74 at the central adjustment position illustrated in FIGS. 4 and 4A. Also, the upper U-shaped beam structure 78 has a generally circular cross section and a plastic sleeve segment 96 along a contact line between the upper structure 78 and the mouthpiece 74. This arrangement improves frictional resistance along an arc of contact between the upper structure 78 and the mouthpiece 74.

A fourth presently preferred embodiment is set forth in FIGS. 8, 8A, 9, 9A, 10, 10A, 11 and 11A. In this embodiment a reed contactor plate 312 contacts and retains the reed 72 along longitudinal edge contact lines as previously described above. The reed contactor plate 312 defines a longitudinal slot 319 holding a single guide pin 317 against transverse displacement while permitting displacement of the contactor plate 312 along a longitudinal axis of the reed 72 and mouthpiece 74, in the same manner as shown and discussed above in conjunction with the third preferred embodiment. A lower beam structure 376 defines a cavity 329 for locating and retaining in a side-by-side configuration two bearing ball spheres 316A and 316B. These spheres 316A and 316B contact the central guide pin 317 along parallel contact lines across a range of adjustment, illustrated in FIGS. 8, 8A (central position with retainer gap 325 equidistant from retainer 386), 9, 9A (inside position) and 10, 10A (outside position). This arrangement, as with the third preferred embodiment above, enables the user to adjust actual clamping force application along a short longitudinal length of the reed 72 while maintaining desired vibrational isolation of the ligature structure 370 from the mouthpiece 74. In other respects, the ligature system 370 achieves the same results as the embodiment set forth in connection with FIGS. 4, 4A, 5, 5A, 6, 6A, 7, and 7A set forth herein and explained above.

Figure 12A:
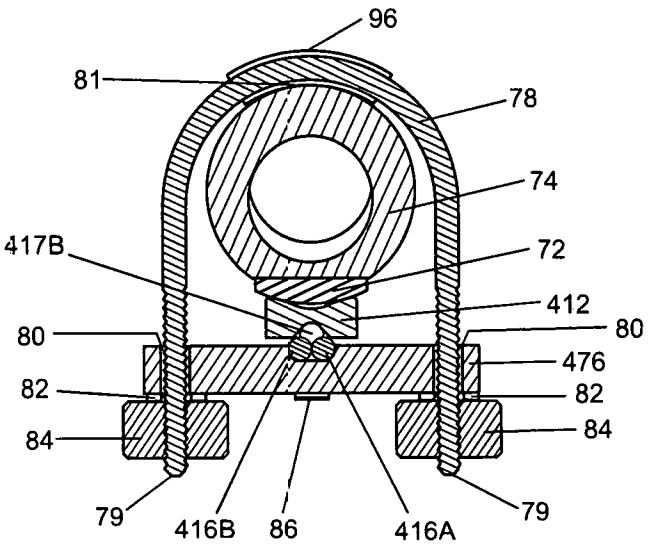
FIG. 12A is sectional view of the FIG. 12 structure taken along section line A-A in FIG. 12
Figure 12:
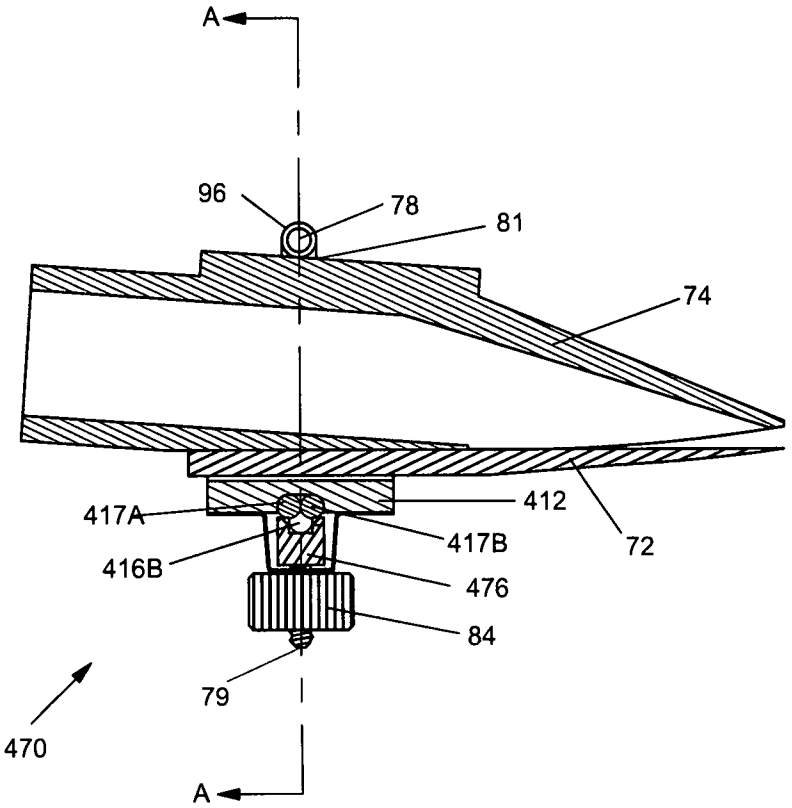
FIG. 12 is a diagrammatic view in elevation and longitudinal section of a ligature system, reed and mouthpiece having an improved rotational pivot in accordance with the present invention.
Figure 12F:
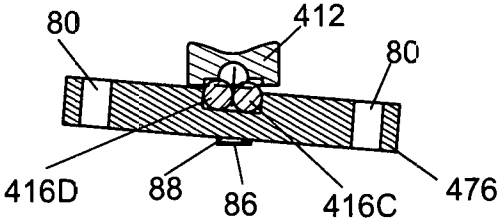
FIG. 12F is a diagrammatic sectional view taken normal to the FIG. 12E view showing a roll rotation of the lower beam structure along a locus following the X axis dimension of the ligature system.
Figure 12E:
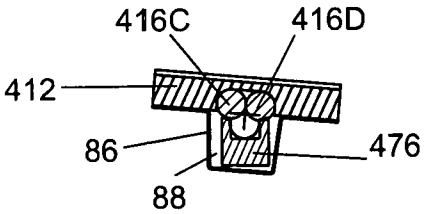
FIG. 12E is a diagrammatic sectional view of the reed contactor plate of FIG. 12 shown in a pitch rotation relative to the lower beam structure along a locus following the Z axis dimension of the ligature system.
Figure 12D:
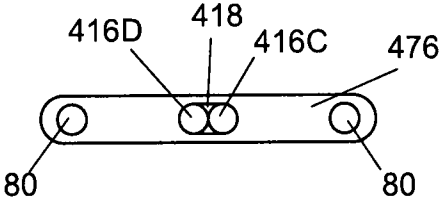
FIG. 12D is a detail view of the lower beam structure shown in section in FIG. 12A illustrating a cavity holding the two lower balls of the FIG. 12A view.
Figure 12C:
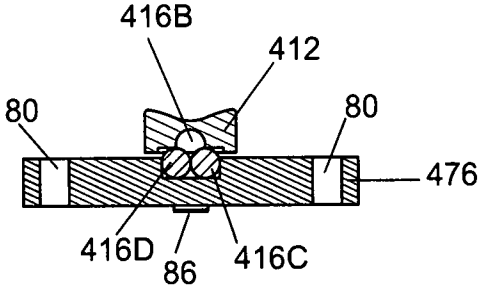
FIG. 12C is a sectional view of the contactor plate and lower beam structure of the FIG. 12 ligature showing one of the top spheres in contact with the two spheres located and retained by the lower beam structure.
Figure 12B:
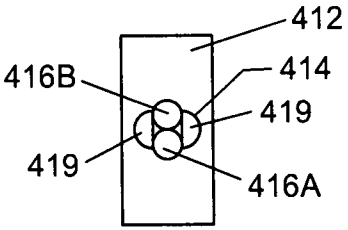
FIG. 12B is a diagrammatic bottom plan view of the reed contactor plate of the FIG. 12 embodiment showing two of the four precision spheres that are located and retained by cavity structure defined by the contactor plate.

A fifth presently preferred embodiment is set forth in FIGS. 12, 12A, 12B, 12C, 12D and 12E. In this embodiment a ligature system 470 has a pivot using four bearing ball spheres 416A, 416B, 416C and 416D of substantially equal diameter which are arranged in juxtaposition to be in contact with each other as two pairs. A first pair, spheres 416A and 416B are located and retained within a first cavity 417 defined in a reed contactor plate 412. The cavity 417 includes side recesses 419 to avoid interference with the spheres 316C and 316D during mounting and use of the ligature system 470. The second pair, spheres 416C and 416D, are located and retained within a second cavity 418 defined in the beam structure 476. The cavities 417 and 418 are arranged perpendicularly in the plan views of FIGS. 12B and 12D so that, in this example, spheres 416C and 416D are aligned parallel with respect to a major longitudinal axis of the reed 72, and spheres 316A and 316B are aligned transversely with respect to the major axis of the reed 72. Of course, in practice this alignment could be inverted, so that spheres 416C and 416D would be aligned with the major axis, and spheres 416A and 416B would be aligned transverse with the major axis. While two-sphere cavities 414 and 418 are shown, those skilled in the art will appreciate that individual cavities could be defined for each of the spheres 416A, 416B, 416CC, and 416D. When assembled, each sphere 416 has two contact points with adjacent other spheres, and the ligature assembly 470 functions in accordance with the embodiments illustrated above in providing the three-dimensional rotational pivot mechanism of the present invention. FIG. 12E illustrates how the ligature structure 470 accommodates misalignment of the contactor plate 412 relative to the lower beam structure 476 in a longitudinal pitch around the X axis. Retainer 86 limits the degree of pitch to the size of the gap 88 which provides a limit to the pitch displacement. FIG. 12F illustrates how the ligature structure 470 handles misalignment of the contactor plate structure 412 relative to the lower beam structure 476 in a roll around the Z axis. Again, the retainer 86 limits the extent of the roll displacement.

To those skilled in the art, many changes and modifications will be readily apparent from consideration of the foregoing description of preferred embodiments without departure from the spirit of the present invention. The descriptions and drawings herein and the disclosures hereof are by way of illustration only and should not be construed as limiting the scope of the present invention which is more particularly pointed out by the following claims.

I claim:

1. In a single reed woodwind ligature system having an upper structure for contacting the upper portion of a mouthpiece at one or more small areas of contact, a reed contactor for contacting a reed at a portion of its bottom curved surface, a lower structure that attaches the reed contactor by a rotational pivot, a left side and right side vertical adjustment structure including a plurality of threaded segments and threaded hand nuts enabling a user to clamp the upper structure to the lower structure with the capability to vary the distance between the upper structure and the lower structure to enable clamping of a mouthpiece, an improved rotational pivot comprising:

the reed contactor defining a first cavity and the lower structure defining a second cavity in alignment with the first cavity, and at least one sphere located and contained partially within the first and second cavities in contact with, and spacing apart, the lower structure and the reed contactor in a manner creating a pivot mechanism capable of roll, pitch and yaw rotations in three dimensions around the approximate center of the at least one sphere when the ligature system is secured by a user to the reed to the mouthpiece, and further comprising retainer means for retaining the reed contactor and sphere in assembly with the lower structure when the ligature is unsecured by a user from the reed and mouthpiece.

2. The rotational pivot set forth in claim 1 wherein the retainer means comprises a generally U-shaped retainer having substantially flat surfaces facing generally flat walls of the lower structure, the retainer defining a gap region between the retainer and the lower structure such that narrow line contact area limits transfer of vibrational energy from the reed and contactor plate to the ligature system at positional limits of pitch and roll rotations of the lower structure relative to the reed contactor.

3. The rotational pivot set forth in claim 1 wherein the reed contactor defines a centrally located generally rectangular first cavity, four spheres held in and constrained against lateral movement by surfaces of said first cavity, a second cavity defined in said lower structure at a central location thereof, and a fifth sphere located at a vertical center of said four spheres, the fifth sphere held in and constrained against lateral movement by said second cavity and in contact with said four spheres when said ligature system is attached to the mouthpiece and reed by the user.

4. The rotational pivot set forth in claim 3 wherein the retainer means comprises a retainer attached to the lower structure for surrounding and retaining the reed contactor in a spaced away relationship sufficient to permit pivotal movement of the reed contactor relative to the lower structure while retaining the four spheres and the fifth sphere in position when the ligature system is not clamping the reed to the mouthpiece.

5. The rotational pivot set forth in claim 1 wherein the reed contactor defines a centrally located generally triangular first cavity, three spheres held in and constrained against lateral movement by surfaces of said first cavity, a second cavity defined in said lower structure at a central location thereof, and a fourth sphere located at a vertical center of said three spheres, the fourth sphere held in and constrained against lateral movement by said second cavity and in contact with said three spheres when said ligature system is attached to the mouthpiece and reed by the user.

6. The rotational pivot set forth in claim 5 wherein the retainer means comprises a retainer attached to the lower structure for surrounding and retaining the reed contactor in a spaced away relationship sufficient to permit pivotal movement of the reed contactor relative to the lower structure while retaining the three spheres and the fourth sphere in position when the ligature system is not clamping the reed to the mouthpiece.

7. The rotational pivot set forth in claim 1 wherein the reed contactor plate defines structure for holding two bearing pins in parallel with a longitudinal axis of the contactor plate and in a spaced apart relation, and wherein the at least one sphere contacts the two bearing pins, enabling the user to adjust a clamping force center along a range extending longitudinally along the two bearing pins before the ligature system is tightened by the user.

8. The rotational pivot set forth in claim 7 wherein the retainer means comprises a retainer attached to the lower structure for surrounding and retaining the reed contactor in a spaced away relationship defining a longitudinal gap sufficient to retain the two bearing pins and the at least one sphere in position when the ligature system is not clamping the reed to the mouthpiece while enabling a range of longitudinal adjustment of the at least one sphere and contactor plate relative to the lower structure.

9. The rotational pivot set forth in claim 1 wherein the reed contactor plate defines structure for holding a bearing pin in parallel with a longitudinal axis of the contactor plate, and wherein the contactor plate defines a cavity sized to receive two spheres in side-by-side transverse relationship to the axis where in the two spheres contacts the bearing pin, enabling the user to adjust a clamping force center over a range extending longitudinally along the bearing pin before the ligature system is tightened by the user.

10. The rotational pivot set forth in claim 9 wherein the retainer means comprises a retainer attached to the lower structure for surrounding and retaining the reed contactor in a spaced away relationship defining a longitudinal gap sufficient to retain the bearing pin and the two spheres in position when the ligature system is not clamping the reed to the mouthpiece while enabling a range of longitudinal adjustment of the at least one sphere and contactor plate relative to the lower structure.

11. The rotational pivot set forth in claim 1 wherein the reed contactor defines a centrally located longitudinal first cavity means, first and second spheres held in and constrained against lateral movement by surfaces of said first cavity means, the lower structure defines a second centrally located transverse cavity means defined in at a central location thereof and third and fourth spheres held in and constrained by surfaces of said second cavity, the third and fourth spheres being in contact with the said first and second spheres when said ligature system is attached to the mouthpiece and reed by the user.

12. The rotational pivot set forth in claim 11 wherein the retainer means comprises a retainer attached to the lower structure for surrounding and retaining the reed contactor in a spaced away relationship defining a longitudinal gap sufficient to retain the first, second, third and fourth spheres in position when the ligature system is not clamping the reed to the mouthpiece.

13. The rotational pivot set forth in claim 1 wherein the reed contactor defines a centrally located transverse first cavity means, first and second spheres held in and constrained against lateral movement by surfaces of said first cavity means, the lower structure having a sufficient width dimension to define and form a second centrally located longitudinal cavity means defined in at a central location thereof and parallel with a longitudinal; axis of the reed, and third and fourth spheres held in and constrained by surfaces of said second cavity, the third and fourth spheres being in contact with the said first and second spheres when said ligature system is attached to the mouthpiece and reed by the user.

14. The rotational pivot set forth in claim 13 wherein the retainer means comprises a retainer attached to the lower structure for surrounding and retaining the reed contactor in a spaced away relationship defining a longitudinal gap sufficient to retain the first, second, third and fourth spheres in position when the ligature system is not clamping the reed to the mouthpiece.

15. A ligature system for clamping a single reed to a mouthpiece of a woodwind musical instrument comprising an upper generally U-shaped structure for contacting the upper portion of a mouthpiece at a single small area of contact, a reed contactor plate for contacting a reed at a portion of its bottom curved surface, a lower beam structure having slightly oversized end openings and attaching the reed contactor by a rotational pivot, a left side and right side vertical adjustment structure including a plurality of threaded end segments of the generally U-shaped upper structure and threaded hand nuts engaging the threaded end segments extending through said slightly oversized end openings thereby enabling a user to clamp the upper structure to the lower structure with the capability to vary the distance between the upper structure and the lower structure to enable clamping the single reed to the mouthpiece while minimizing vibrational energy transfer from the ligature structure to the mouthpiece, and wherein said rotational pivot comprises:

the reed contactor plate defining a first cavity means and the lower beam structure defining a second cavity means in alignment with the first cavity means, and at least four spheres located and contained partially within the first and second cavity means and in contact with, and for spacing apart, the lower beam structure and the reed contactor plate in a manner providing the pivot mechanism with of roll, pitch and yaw rotations in three dimensions when the ligature system is secured by a user to the reed to the mouthpiece, and further comprising retainer means for retaining the reed contactor and spheres in assembly with the lower structure when the ligature is unsecured by a user from the reed and mouthpiece.

16. The ligature system set forth in claim 15 wherein the reed contactor plate defines a centrally located generally triangular first cavity, three of said spheres being held in and constrained against lateral movement by surfaces of said first cavity, a second cavity defined in said lower beam structure at a central location thereof, and the fourth said sphere being located at a vertical center of said three spheres, the fourth sphere being held in and constrained against lateral movement by said second cavity and in contact with said three spheres at contact areas when said ligature system is attached to the mouthpiece and reed by the user, and wherein the rotational pivot enables roll, pitch and yaw rotations in three dimensions around the approximate center of the fourth sphere when the ligature system secures the reed to the mouthpiece.

17. The ligature system set forth in claim 15 wherein the reed contactor plate defines a first centrally located cavity along a longitudinal axis of the plate and wherein a first pair of said spheres are held and constrained against lateral movement by the first cavity, wherein the lower beam structure defines a second centrally located cavity along a central axis perpendicular to the longitudinal axis of the reed contactor plate and wherein a second pair of said spheres are held and constrained against lateral movement by the second cavity, the second pair of spheres being in contact at contact areas with the first pair of spheres to form the rotational pivot.

18. A ligature system for clamping a single reed to a mouthpiece of a woodwind musical instrument comprising an upper generally U-shaped structure for contacting the upper portion of a mouthpiece at a single small area of contact, a reed contactor plate for contacting a reed at a portion of its bottom curved surface, a lower beam structure having slightly oversized end openings and attaching the reed contactor by a rotational pivot, a left side and right side vertical adjustment structure including a plurality of threaded end segments of the generally U-shaped upper structure and threaded finger nuts engaging the threaded end segments extending through said slightly oversized end openings thereby enabling a user to clamp the upper structure to the lower structure with the capability to vary the distance between the upper structure and the lower structure to enable clamping the single reed to the mouthpiece while minimizing vibrational energy transfer from the ligature structure to the mouthpiece, and wherein said rotational pivot comprises:

the reed contactor plate defining a generally rectangular first cavity means, bearing pin means in the first cavity parallel with a longitudinal axis of the reed, the lower beam structure defining second and third cavities in transverse alignment with the longitudinal axis and spaced equidistant from an axis of the bearing pin means, and at least one sphere contained partially within the second and third cavities and in contact with the bearing pin means, and for spacing apart the lower beam structure and the reed contactor plate in a manner providing the pivot mechanism with of roll, pitch and yaw rotations in three dimensions when the ligature system is secured by a user to the reed to the mouthpiece, and further comprising retainer means for retaining the reed contactor and spheres in assembly with the lower structure when the ligature is unsecured by a user from the reed and mouthpiece, the retainer means defining a gap along the longitudinal axis for providing a limit of rotation of the rotational pivot.

19. The ligature system set forth in claim 18 wherein said bearing pin means comprises two substantially parallel pins, and wherein said at least one sphere comprises a single sphere in contact with an area of contact along each one of said two substantially parallel pins.

20. The ligature system set forth in claim 18 wherein said bearing pin means comprises a single pin, and comprising two spheres in contact with areas of contact along said single pin.

* * * * *